US005178570A

United States Patent [19]

Tomiyama et al.

[11] Patent Number: 5,178,570

[45] Date of Patent: Jan. 12, 1993

[54] MANUFACTURING METHOD OF CATHODE RAY TUBE

[75] Inventors: Kozo Tomiyama, Yachimata; Taira Yarita, Mobara; Takashi Shimokawa, Sakura; Yukio Kuribayashi, Yachimata; Yasutoshi Katsume, Sakura; Takumi Karasawa, Sakura, all of Japan

[73] Assignee: Hitachi, Ltd., Tokyo, Japan

[21] Appl. No.: 720,002

[22] Filed: Jun. 24, 1991

[30] Foreign Application Priority Data

Jun. 22, 1990 [JP] Japan ..... 2-162917
Apr. 22, 1991 [JP] Japan ..... 3-090309

[51] Int. Cl.[5] ..... H01J 9/00
[52] U.S. Cl. ..... 445/5
[58] Field of Search ..... 445/5

[56] References Cited

U.S. PATENT DOCUMENTS 4,326,762 4/1982 Hockenbrock et al. ..... 445/5
4,940,440 7/1990 Redkopf et al. ..... 445/5

FOREIGN PATENT DOCUMENTS 16005 1/1967 Japan ..... 445/5

*Primary Examiner*—Kenneth J. Ramsey
*Attorney, Agent, or Firm*—Antonelli, Terry, Stout & Kraus

[57] ABSTRACT

A manufacturing method of cathode ray tube, wherein the voltage applied to the anode of an electron gun is divided by a voltage divider for application to focusing electrodes of the electron gun in the knocking process.

6 Claims, 4 Drawing Sheets

MANUFACTURING METHOD OF CATHODE RAY TUBE

The present invention relates to a manufacturing method of cathode ray tubes such as a color picture tube and a color display tube, and particularly to a manufacturing method of cathode ray tubes whereby a knocking process can be performed effectively for large color cathode ray tubes by a comparatively low knocking voltage.

BACKGROUND OF THE INVENTION

Generally, in a manufacturing method of cathode ray tubes, a knocking treatment is performed in the post process of the manufacturing assembly processes, as a process for improving the withstand voltage characteristics, to remove fine projections on the electrodes constituting an electron gun, flashes and fluffs generated by the pressing formation, and dust and other foreign substances affixed to the electrode surfaces in order to reduce current leakage and intensify the resistance against heat and vibration from outside for the purpose of obtaining a long and stable performance.

Conventionally, as knocking treatment process of the kind, a spot knocking method, an indirect knocking method and others are known.

FIG. 6 is a view showing the connecting structure of an example in which a conventional spot knocking method is applied to a large color cathode ray tube (29", 31", etc.) with an electron gun of EA-DF type (elliptical aperture dynamic focus type with elliptical electron beam passage). FIG. 8 is a view showing the actual structure of the EA-DF type electron gun as a reference. In FIG. 6 and FIG. 8, a reference mark G1 designates a first grid electrode; G2, a second grid electrode (screening electrode); G3, a third grid electrode (controlling electrode); G4, a fourth grid electrode; G5, a fifth grid electrode (in practice, the electron gun comprises each unit of G5-1, G5-21, and G5-2); G6, a sixth grid electrode (anode unit); SC, a shield cup; K, a cathode electrode; and ST, a stem. Between the G2 electrode and G4 electrode, and the G3 electrode and G5 electrode, the inner connections are respectively made. In this respect, the cathode K should be grounded when the knocking is performed, but such grounding is not shown in FIG. 6 in order to simplify the representation.

The usual operating voltages are −60 V to 0 V for the cathode K, 0 V for the G1 electrode, 600 V for the G2 and G4 electrode, 9 KV (applied as a focus voltage Vf of approximately 28% of Eb) for G3 and G5 electrodes, and approximately 30 KV (high voltage supply Eb) for G6 electrode, and an electron lens focusing system is constituted between G3-G4, G4-G5, and G5-G6.

In the spot knocking method, the cathode electrode K, G1 electrode, G4 and G2 electrodes and G5 and G3 electrodes are all grounded as shown in FIG. 6, while only the G6 electrode is connected to a high-voltage supply Eb having an induction two times the operating voltage (for example, a positive pulse voltage of 70 KV, 50 Hz, pulse width 0.05 ms, for example). Thus, the knocking treatment is performed by generating a spark from the G6 electrode to the G2 electrode through the G5 or G3 electrode.

FIG. 7 is a view showing the connecting structure of an example by the conventional technique, in which an indirect knocking method is applied to a color cathode ray tube also with the EA-DF type electron gun. In this knocking method, what differs from the structure shown in FIG. 6 is that the G5 and G3 electrodes are grounded through a resistor R2 (10 KΩ) instead of the direct grounding thereof. In this indirect knocking method, a spark current flows into the resistor R2 by the sparking from the G6 electrode to the G5 and G3 electrodes. Hence, a voltage VG3 is induced to the electrode G5 and G3, and this induced voltage VG3 causes a secondary spark from the G5 and G3 electrodes to the G4 and G2 electrodes to perform the knocking. Thus, this knocking is called the G2-G3 indirect knocking.

In this respect, there is known a float knocking method (refer to Japanese Patent Laid-Open No. 154034/1980), wherein the G5 and G3 electrodes in the spot knocking method shown in FIG. 6 are opened instead of being grounded, and a high voltage is applied to the G6 electrode.

The spot knocking method, G2-G3 indirect knocking method or the float knocking method by the above-mentioned conventional technique are all such that the high voltage for knocking, which is supplied from the outside, is applied only through the G6 electrode. Therefore, the sparking is easily generated from the G6 electrode to the comparatively high electrodes (nearer to the G6 electrode), but it is always difficult to generate the sparking to the comparatively low electrodes (farther from the G6 electrode). Consequently, there is the problem that the A stray (a cold emission from the said electrode reaches the phosphor screen to illuminate it) by the lower electrodes and the B stray (a leak current by emission between the electrodes) are generated.

Particularly, in the above-mentioned electron gun, such as the EA-DF type and the EA-UB type (elliptical aperture unipotential-bipotential type), for which the focusing has been improved recently to obtain a better quality of the larger color cathode ray tubes of 29", 30" or the like, the distance between the G6 electrode and the G2 electrode is long as compared with the conventional B-U type (bipotential-unipotential type) electron gun. Therefore, it is easy to effectuate the knocking by the comparatively high controlling electrode G3 (nearer to the G6 electrode) but it is difficult to effectuate the knocking by the low G2 electrode farther from the G6 electrode. Hence, there is the problem that the G2 A stray (A stray by the emission of the G2 electrode) defect occurs quite often in the course of the manufacturing process.

Also, a higher voltage may be applied to the G6 electrode in order to make it easier to effectuate the knocking by the low electrodes (farther from the G6 electrode). However, the voltage to be applied to the anode electrode is limited to a certain level because it can cause dielectric breakdown or creeping discharge between the lead wires or terminals.

Therefore, an object of the present invention is to provide a manufacturing method of cathode ray tubes, wherein a relatively low voltage is applied to knock lower electrodes such as G2 so as to eliminate defects such as G2 A stray) while solving the above-mentioned problems encountered in the conventional technique.

SUMMARY OF THE INVENTION

In order to achieve the above-mentioned object, the manufacturing method of cathode ray tubes according to the present invention is characterized in that the voltage applied to the anode is divided by a resistor of a high resistance value for the application of the voltage to the lower electrodes (G5 and G3 electrodes which function as focusing electrodes, for example) in the knocking process.

The function based on the above-mentioned structure will be described.

When the anode voltage is initially applied to the anode (G6), the voltage divided by the high-resistance voltage dividing resistor is applied between the anode and the low electrodes (focusing electrodes G5 and G3) and between the low electrodes G5 and G3 and the grounding, and at first, the potential difference between the anode (G6) and the low electrodes G5 and G3 is lowered by the discharging therebetween and at the same time, the potential of the low electrodes (G5 and G3) is momentarily raised. This raised potential causes the electrode (screen electrode G2) which is still lower than the low electrodes (G5 and G3) to be discharged. With this discharge, the potential of the low electrodes (G5 and G3) is lowered to cause the potential difference between the anode and the low electrodes (G5 and G3) to be raised. A phenomenon such as this repeatedly occurs, and particularly, a high voltage is momentarily applied to the low electrodes G5 and G3 as the above describes. Therefore, not only between the anode and the low focusing electrodes but also between the low focusing electrodes and the screening electrode G2 which is further lower than the low focusing electrodes, the discharging is perfectly effectuated. As a result, the knocking effect for this electrode G2 is increased.

Thus, it is possible to reduce the A stray defective ratio in the G2 system.

PREFERRED EMBODIMENTS OF THE INVENTION

An embodiment of the present invention is described below in conjunction with FIG. 1 and FIG. 2.

Figure 1:
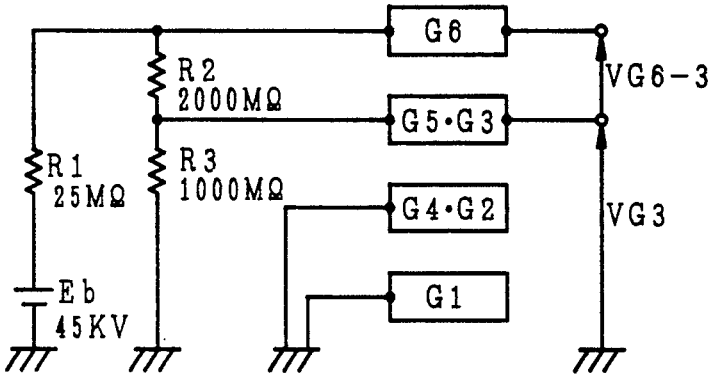
FIG. 1 is a view showing the connecting structure at the time of knocking for the electron gun according to an embodiment of the present invention.

FIG. 1 is a view showing the connecting structure according to the present invention, in which a knocking process is applied to the electron gun for an EA-DF type color cathode ray tube. For the same members appearing in FIG. 3, the same reference marks are provided and the descriptions thereof will be omitted. Also, in order to simplify the representation of the structure, the heater and cathode (grounded) are not shown in FIG. 1.

A d.c. voltage Eb (45 KV, for example) is applied to the anode (the sixth grid electrode) G6 through a resistor R1 (25 MΩ, for example), and a high-resistance value resistor R2 (2,000 MΩ, for example) is connected between the anode G6 and the focusing electrodes G5 and G3 (the fifth and third grid electrodes). Also, a high-resistance value resistor R3 (1,000 MΩ, for example) is connected between the focusing electrodes G5 and G3 and the grounding. The values of the resistors R2 and R3 should be sufficiently larger than that of the resistor R1. The screen grids G4 and G2 and the control grid G1 are grounded.

Figure 2:
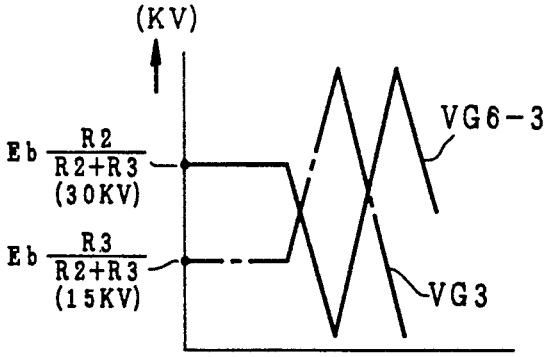
FIG. 2 is a waveform diagram showing the fluctuating state of the potential difference between the electrodes of the electron gun.

FIG. 2 shows the fluctuation of the potential difference level VG6-3 between the anode G6 and the focusing electrodes G5 and G3 when the d.c. voltage Eb is applied in the connecting structure shown in FIG. 1, and the fluctuation of the potential difference level VG3 between the focusing electrodes G5 and G3 and the grounding.

When the voltage Eb is initially applied to the anode electrode, the potential differences VG6-3 and VG3 represent the potential division ratios $Eb \times R2/(R2+R3)=30$ KV, and $Eb \times R3/(R2+R3)=15$ KV in response to each of the resistance values. However, when a discharge occurs, or leakage current flows, between the anode G6 and the focusing electrode G5 and G3, the entire resistance between the anode and the focusing electrodes is reduced. As a result, the potential difference VG6-3 is lowered and at the same time, the VG3 is raised with the induced high potential of the focusing electrodes G5 and G3. By this raised potential VG3, a discharging occurs or a leakage current flows between the focusing electrodes and the screening electrode G2. Thus, the entire resistance between the focusing electrodes and the grounding is reduced. Accordingly, the potential difference VG3 is lowered and at the same time, the potential difference VG6-3 is raised. At each time a phenomenon such as this is sequentially repeated, the spark discharging also repeatedly occurs from the focusing electrodes G5 and G3 to the screening electrodes G2 and G4. Therefore, the knocking for the screening electrode is effectively performed reliably.

The amplitude of the voltage fluctuations of the potential differences VG6-3 and VG3 is adjustable by varying the values of high resistances R2 and R3. The greater the resistance values, the larger becomes the voltage fluctuation amplitude. Also, it is possible to determine the optimum values of the potential dividing resistances R2 and R3 by experiments in accordance with the configuration of the electron gun (the distance between the electrodes, and others). In the present embodiment, the R2 is 2,000 MΩ and R3, 1,000 MΩ, and when the ratio between them is 2:1, an excellent result is obtainable. According to the present embodiment, even if a d.c. power is employed as the voltage Eb, the VG6-3 and VG3 greatly fluctuate. Consequently, the knocking effect for the electrodes G4 and G2 are great.

Also, according to the knocking method embodying the present invention, the voltage to be applied to the anode electrode, 70 KV in the conventional method, can be reduced to 50 KV or less (45 KV) which is, for example, 1.5 times the operating voltage (35 KV). As a result, the knocking treatment is reliably performed for the low electrode such as a screening electrode by an applied voltage of a low level.

Figure 3:
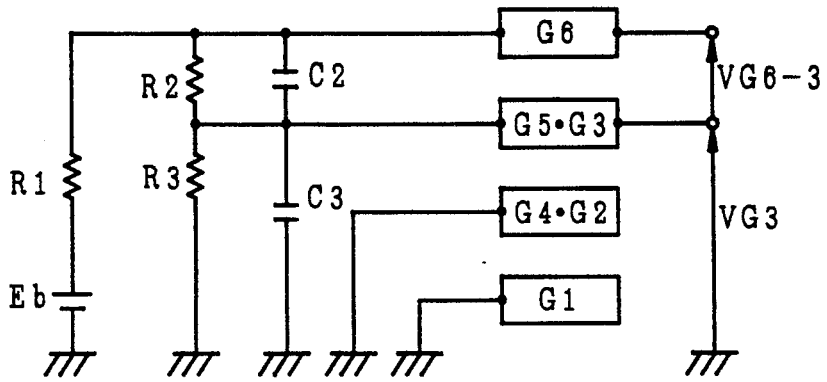
FIG. 3 is another embodiment of the present invention.

FIG. 3 shows another embodiment according to the present invention. FIG. 3 represents a structure in which capacitors C2 and C3 are connected in parallel to the potential dividing resistors R2 and R3. The stray capacitance of an electron gun differs by its type, the number of electrodes and others, and according to the difference of the stray capacitance, the knocking condition of electrodes differs. Therefore, by using the capacitors in parallel as in the present embodiment, it is possible to reduce the variation in stray capacitance of different types of electrodes and make the knocking conditions comparatively equal. Also, by connecting the parallel capacitors C2 and C3, it is possible to prevent any extremely high peak voltage caused by the transient phenomena from being applied between the electrodes in order to reduce the possibility of the side effect of the cathode breakage and others. Although the two parallel capacitors C2 and C3 are employed in FIG. 3, it may be possible to use only either one of C2 or C3 depending on the processing condition.

Figure 4:
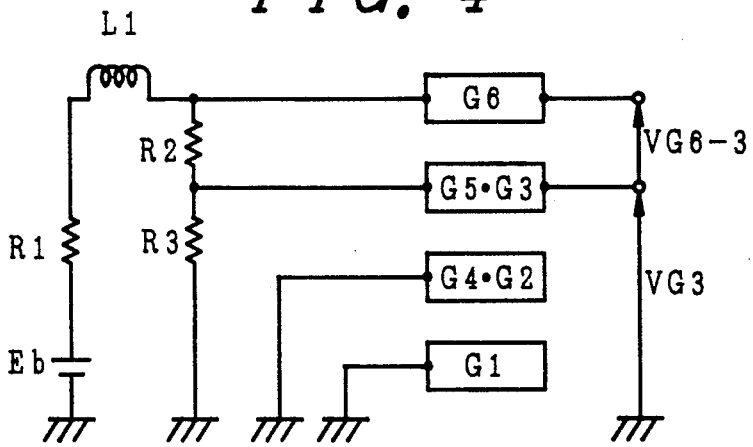
FIG. 4 is still another embodiment of the present invention.

FIG. 4 shows still another embodiment according to the present invention. In this embodiment, an inductance L1 is inserted in series to the power supply to prevent the damage to the cathode and others caused by the application of an extremely high voltage to the electron gun due to the transient phenomena. In FIG. 4, while the potential division is performed by the resistors R2 and R3 only, the potential division can be performed by the combination of resistor and capacitor as shown in FIG. 3 as a matter of course.

Figure 5:
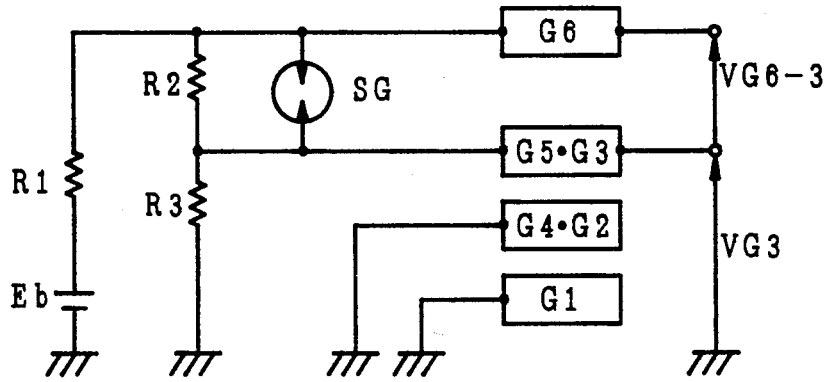
FIG. 5 is yet another embodiment of the present invention.
Figure 6:
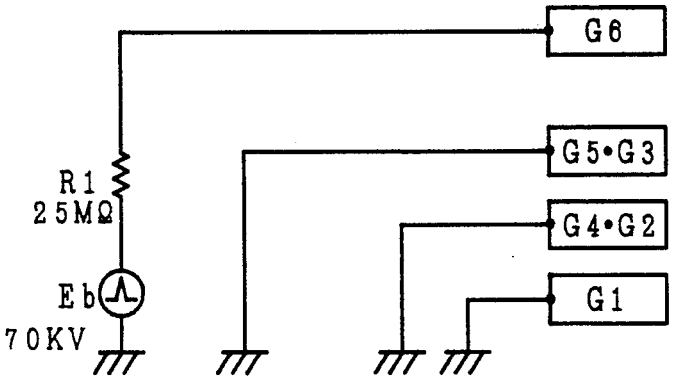
FIG. 6 PRIOR ART
FIG. 6 is a conventional knocking method.
Figure 7:
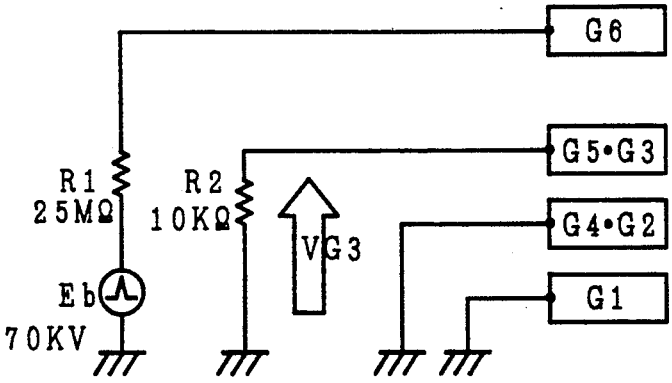
FIG. 7 PRIOR ART
FIG. 7 is another conventional knocking method.
Figure 8:
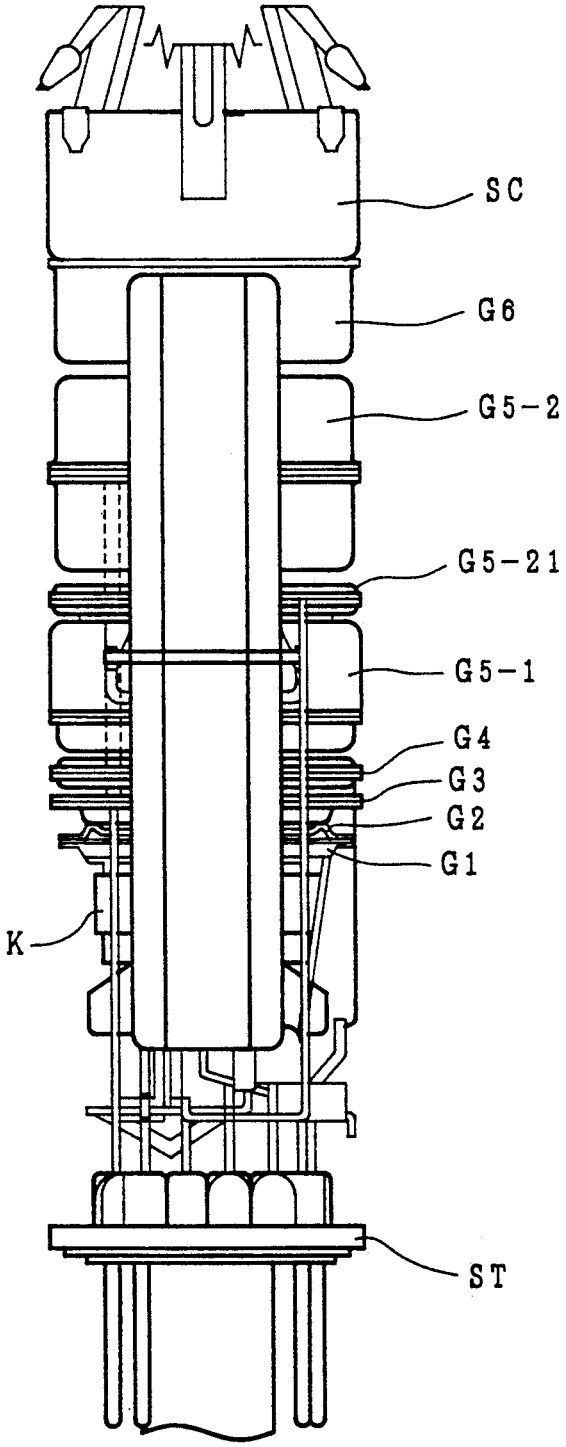
FIG. 8 is a structural view showing the electron gun for a general cathode ray tube.

FIG. 5 shows a further embodiment according to the present invention. In the present embodiment, a spark gap SG is inserted in parallel with the resistor R2. With the spark gap, it is possible to prevent the cathode and others of the electron gun from being destroyed by the VG6-3 becoming extremely high due to the transient phenomena. In FIG. 5, although the spark gap is provided in parallel with the resistor R2, it may be possible to provide the spark gap SG in parallel with the resistor R3 or to provide spark gaps each in parallel with the resistors R3 and R2.

In the present embodiment, while the power supply Eb has been described as a d.c. power, the power supply can be an a.c. power or a pulse voltage, and it is needless to mention that the same operational effects can be obtained.

For the above-mentioned embodiments, the descriptions have been made of the knocking method of a color cathode ray tube with the EA-DF electron gun. The present invention, however, is not limited thereto, and is also applicable to the EA-UB type (elliptical aperture unipotential bipotential type which is of substantially the same structure as the EA-DF type and the anode voltage Eb is provided for the G6 electrode; the focusing voltage Vf, for the G5 and G3 electrodes; and the G2 voltage, for the G4 and G2 electrodes in operation), to the Hi-Fo type (hi-focuing voltage DPF type. The BPF stand for bipotential focus, having K and G1-G4 electrodes and in operation, the anode voltage Eb is provided for the G4, and focusing voltage Vf of approximately a 28% fo the Eb is provided for the G3), and to other types.

As set forth above in detail, according to the present invention, the connecting structure in the knocking process of cathode ray tubes, such as CPT (Color Picture Tube) and CDT (Color Display Tube), in such that the applied voltage to the anode is potentially divided by a high resistance for the application to the low electrodes such as the focusing electrodes. Accordingly, it becomes possible to perform the knocking reliably with ease by discharging from the low electrodes such as the focusing electrodes even to the screening electrode G2 which is still lower and far from the anode to make the knocking treatment more difficult. Hence, there is an effect that the A stray defect can be eliminated in the G2 system.

Furthermore, it is possible to effectuate the knocking with a low anode voltage which is approximately 1.5 times the operating voltage to prevent any undesired sparking and creeping discharge between leads in a line and around the sockets effectively.

What is claimed is:

1. A manufacturing method for a cathode ray tube comprising the steps of dividing a voltage applied to an anode of an electron gun by voltage dividing means formed of at least two resistances for application to lower electrodes of the electron gun in a knocking process, and connecting one capacitor in parallel to the at least one of said at least two resistances forming said voltage dividing means.

2. A manufacturing method for a cathode ray tube comprising the steps of dividing a voltage applied to an anode of an electron gun by voltage dividing means formed of at least two resistances for application to lower electrodes of the electron gun in a knocking process, and providing an inductance in series between said voltage dividing means and a knocking power supply.

3. A manufacturing method for a cathode ray tube comprising the steps of dividing a voltage applied to an anode of an electron gun by voltage dividing means formed of at least two resistances for application to lower electrodes of the electron gun in a knocking process, and providing a spark gap in parallel to at least one of said at least two resistances forming said voltage dividing means.

4. A manufacturing method for a cathode ray tube according to claim 1, wherein said voltage dividing means is formed of two resistances having a resistance ratio of 2 to 1.

5. A manufacturing method for a cathode ray tube according to claim 2, wherein said voltage dividing means is formed of two resistances having a resistance ratio of 2 to 1.

6. A manufacturing method for a cathode ray tube according to claim 3, wherein said voltage dividing means is formed of two resistances having a resistance ratio of 2 to 1.

* * * * *